United States Patent [19]

Romanzi, Jr.

[11] 4,064,603

[45] Dec. 27, 1977

[54] SAFETY BELT BUCKLE

[75] Inventor: Louis Romanzi, Jr., Milford, Mich.

[73] Assignee: Gateway Industries, Inc., Chicago, Ill.

[21] Appl. No.: 727,181

[22] Filed: Sept. 29, 1976

[51] Int. Cl.[2] ..... A44B 11/26

[52] U.S. Cl. ..... 24/230 A

[58] Field of Search ..... 24/230 A

[56] References Cited

U.S. PATENT DOCUMENTS

| | | | |
|---|---|---|---|
| 3,256,576 | 6/1966 | Klove | 24/230 A |
| 3,353,234 | 11/1967 | Settlmi | 24/230 A |
| 3,574,902 | 4/1971 | Lohr | 24/230 A |
| 3,686,720 | 8/1972 | Wehner | 24/230 A |
| 3,921,262 | 11/1975 | Tanaka | 24/230 A |
| 4,015,094 | 3/1977 | Gavagan | 24/230 A |

FOREIGN PATENT DOCUMENTS

| | | | |
|---|---|---|---|
| 1,490,780 | 6/1967 | France | 24/230 A |
| 2,127,224 | 12/1971 | Germany | 24/230 A |

*Primary Examiner*—Bernard A. Gelak

*Attorney, Agent, or Firm*—Fitch, Even, Tabin & Luedeka

[57] ABSTRACT

An inexpensive safety belt buckle of relatively small size and lightweight, yet capable of meeting the legal requirements of safety, is disclosed. The buckle includes a latch plate attached to one portion of the safety belt or structural member for insertion with reduced effort into a buckle body attached to another portion of the safety belt or structural member. The length of the buckle is foreshortened by a bent latch lever pivotally mounted on the buckle body and biased for engagement with the latch plate to prevent withdrawal of the latch plate from the buckle body. The height of the buckle is reduced by pivoting the latch lever downward to a release position which is below the plane generally defined by an upper surface of the base plate. The buckle is readily assembled without expanding the side flanges of the base member.

20 Claims, 8 Drawing Figures

10
14
98
35
45
34
12
46
48
36
56
74
72
74
47
39
20
92
65
50
63
38
101
22
16

10
14
97
96
107
98
3.
3.
64
26
74
52
22
72
20
22
90
39
77
65
18
38
90
22
16

Fig. 3.
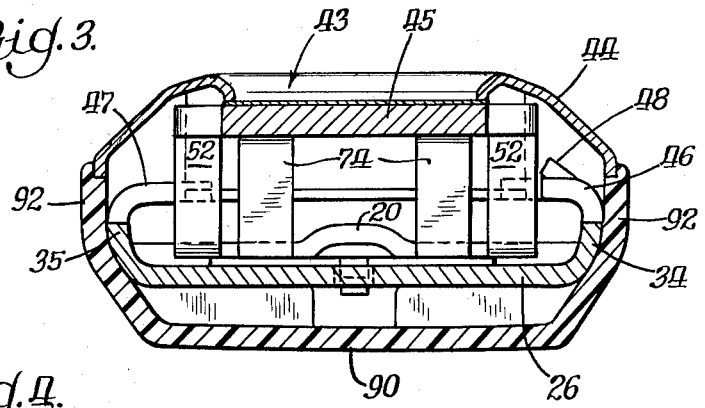
Fig. 4.
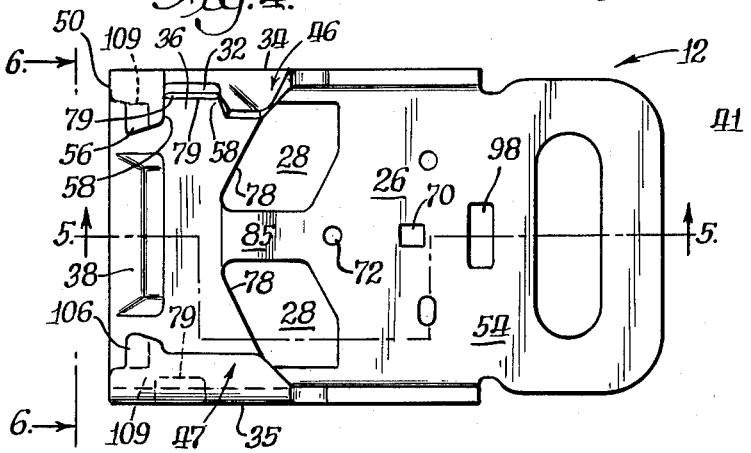
Fig. 7.
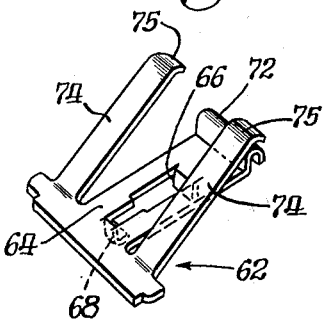
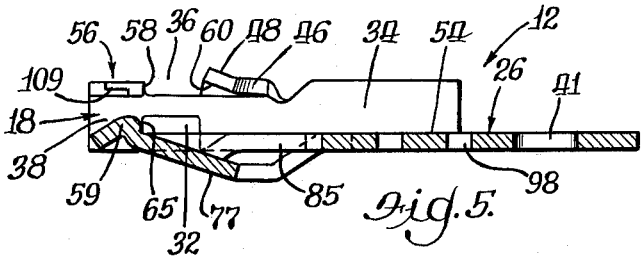
Fig. 5.
Fig. 8.
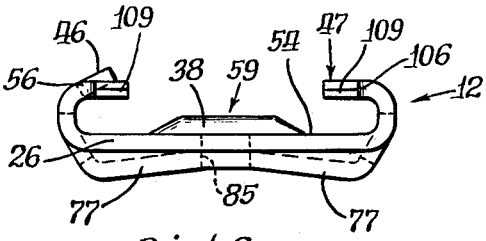
Fig. 6.
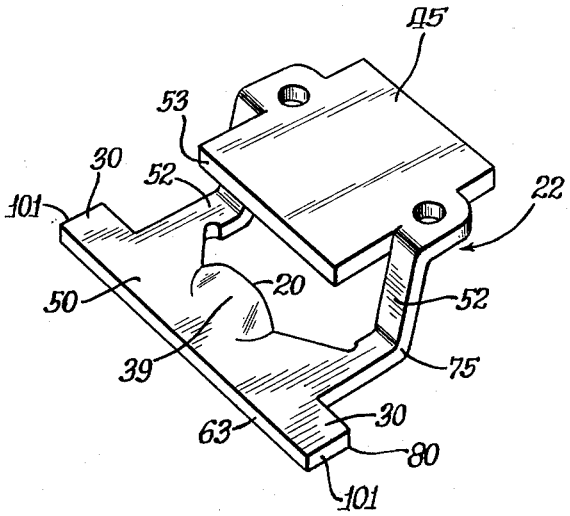

SAFETY BELT BUCKLE

This invention relates generally to safety belt buckles which are used to fasten safety belts about the occupants of airplanes, automobiles, trains or the like. More specifically, the present invention relates to safety belt buckles having a push-button type release mechanism for unfastening the buckle.

Safety belt buckles have long been used for securing seat or safety belts around the occupants of automobiles, airplanes and other vehicles, and many belt buckles have been used which latch securely about the occupant to prevent injury in case of accident or emergency. Usually these buckles include a latch plate or D-ring attached to one-half of a safety belt for insertion into a buckle body attached to the other half of the safety belt or to a structural member. In the past, these buckles have often been large, bulky and unsightly. In vehicles where the buckle rests on the passenger's lap, the extra weight and size often contributed to passenger discomfort, and efforts to improve the appearance, such as by chrome plating the latch plate and buckle body significantly added to the cost of the buckle. In addition, these buckles often contained many functioning parts and required complicated and expensive assembly operations and even after installation, the buckles were sometimes not used by the passengers.

In some buckles, a substantial effort is required to properly insert the latch plate into the buckle body. More recently, emphasis has been on improving the latching mechanisms to provide for easier latching, enhancing the aesthetics and lowering the manufacturing costs. Of course, since safety belt buckles must meet government imposed requirements for strength and for resistance to the various forces which may be encountered, any improvements or changes must not impair or restrict the latching operation of the buckle, which is its most important function.

Accordingly, it is an object of the present invention to provide a safety belt buckle which does not suffer from the deficiencies existing in "prior art" buckles. Another object of the present invention is to provide an attractive safety belt buckle that is relatively small and may be simply constructed from relatively few pieces. A further object of the present invention is to provide a safety belt buckle in which the latch plate may be inserted into the buckle body with minimum effort.

These objects are met by the present invention by providing a safety belt buckle having a buckle body and a latch plate for insertion into the buckle body. The buckle body includes a generally flat base plate above which a one-piece, foreshortened latch lever and push button is pivotally mounted and spring biased to engage the latch plate when it is inserted onto the buckle body. The base plate may be slotted to permit simple mounting of the latch lever pivot arms and may include tapered and cam surfaces to facilitate easy insertion of the latch plate. The base plate may further include opening means to permit pivoting of the latch lever to a release position below the plane generally defined by the surface of the base plate, permitting the buckle to have a lower and more appealing profile.

Additional objects and advantages of the invention are more particularly set forth in the following detailed description and accompanying drawings of which:

FIG. 3 is a vertical sectional view along the line 3—3 of FIG. 2;

FIG. 4 is a top view of a buckle body of the safety belt buckle made in accordance with the present invention;

FIG. 5 is a vertical sectional view along the line 5—5 of FIG. 4;

FIG. 6 is an end view taken along the line 6—6 in FIG. 4 of the buckle body shown in FIG. 4;

FIG. 7 is a perspective view of the biasing spring used in the present invention; and FIG. 8 is a perspective view of the one-piece latch lever and push-button used in the present invention.

Figure 1:
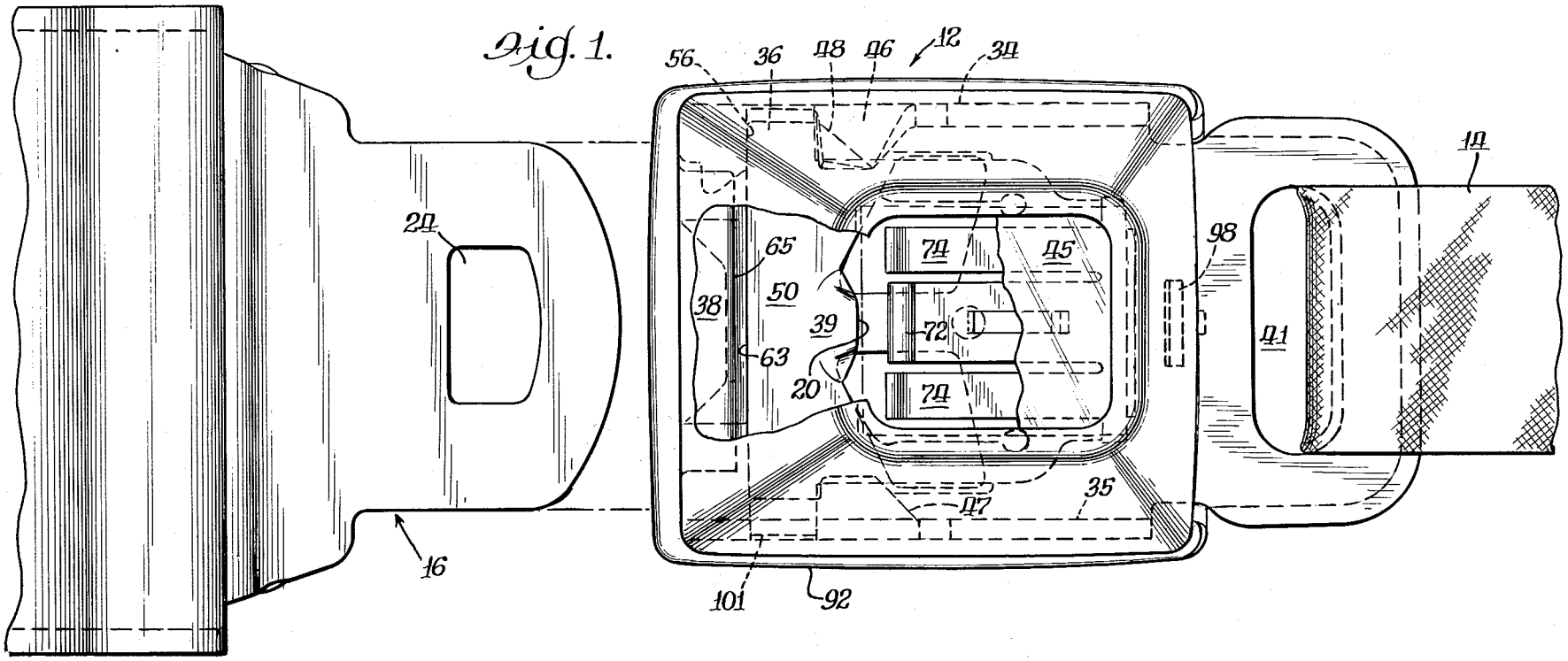
FIG. 1 is a top view, with a top cover partially removed, of a safety belt buckle embodying the present invention.

The present invention is generally embodied in a safety belt buckle 10 for attaching safety belts about the occupants or passengers of moving vehicles. The buckle includes a buckle body 12 attached to a one half of a safety belt 14 or some other structural member and a latch plate 16 for attachment to a second belt half or other structural member. The safety belt may be fastened about a passenger or occupant by inserting the latch plate into an end slot 18 in the buckle body until a raised latch surface 20 of a latch lever 22 which is pivotally mounted on the buckle body snaps into an opening 24 in the latch plate, thereby preventing withdrawal of the latch plate from the buckle body. The buckle may be released by depressing the push-button to pivot the latch lever downwardly until the raised latch surface 20 is withdrawn from the opening in the latch plate, thus permitting withdrawal of the plate.

In accordance with the present invention a small, streamlined safety belt buckle is achieved by foreshortening the latch lever 22 and mounting the same for pivoting about an axis just above the buckle body base plate 26. Although the latch lever pivots about a horizontal axis close to the base plate 26, the latch lever may be displaced downwardly to the necessary extent to an unlatching position as opening means including indentations and a pair of spaced openings 28 in the base plate allow portions of the latch to pivot therein thereby permitting the buckle to be constructed with a lower profile. To facilitate assembly of the buckle without bending one of the upstanding side walls 34 and 35 of the buckle body, a slot 36 is formed in the buckle body to allow swinging of one of a pair of lateral pivot arms 30 of the latch lever into its operative position adjacent the base plate. A minimum effort is needed to insert the plate 16 through the end slot 18 of the buckle body into its latched position because a gently sloped surface 38 on the base plate and a curved frontal side 39 of the raised stop surface 20 guide the latch plate upwardly along the top of latch lever. The latch plate is further guided to the latching position and the insertion force is further reduced by an upward turned corner 48 of the slot defined by the walls 58 in one of the side channels guiding the latch plate down onto the latch lever. The upturned corner provides a small amount of play in the latch plate permitting it to raise slightly to slide more easily over the raised latch surface. Upon further insertion of the latch plate, the curved underside of the corner 48 acts to cam the latch plate downward over the latch surface. The buckle body need not be chrome plated and the openings 28 in the base plate are not exposed because they are covered by a cover means. The latter comprises a plastic shell 42 on the bottom and sides and a stamped metal cover 44 on the top, which includes a central opening 43 for access to a push-button section 45 on the one piece latch lever 22.

Turning now to a more detailed description of the preferred embodiment of the present invention, which is illustrated in the attached drawings, the buckle body 12, which includes the central base plate portion 26, is a generally flat, rectangular plate of sufficient strength, preferably metallic, for transmitting the loads and forces which may arise when a passenger is subjected to shock or vibration. As best seen in FIG. 4, any force or load is transmitted from the buckle body to a structural member (not shown) via the safety belt webbing which is looped through a slot 41 in one end of the buckle body. As an alternative, the buckle body may be directly attached to a structural member. In the latter case, the seat belt which is attached to the latch plate 16 must be of sufficient length to extend completely across the passenger or occupant to attach to the buckle body 12.

At the other end of the buckle body 12, the upstanding side walls 34 and 35 are upwardly bent from and are integral with the base plate 26 and may be formed with portions 46 and 47, which overlie the central base plate, by simple bending operations. The side walls 34 and 35 extend along the side of the buckle body for slightly less than ⅔ of the length of the buckle body, to adjacent the area of the safety belt attachment. The inwardly turned, overlying portions 46 and 47 on the side walls preferably extend only as far along the buckle body as the latch plate 16 is likely to be inserted. By way of example of the small size attained for the preferred buckle body, it may be only about 2.76 inches long and 1.70 inches wide. The upstanding side walls 34 and 35 are about 1.86 inches in length and provide a buckle body thickness of about 0.5 inches. The inwardly turned portions on the side walls extend slightly less than 1.0 inches from the front or slotted end of the buckle body.

In many of the prior art commercial buckles, the buckle body is significantly heavier and, because these prior art buckle bodies are exposed to user, they are chrome plated for aesthetic reasons. Chrome plating is a significant expense and is preferably eliminated in the present invention by covering it with a cover means formed of the bottom shell 42 and the top cover 44. Because of the foreshortening latch lever 22 and the simple guiding and aligning functions achieved by the overlying projection means 46 and 47, the buckle body has eliminated the long inturned flange walls which extended the full length of the side walls in these prior art buckles and which are parallel to the buckle base wall. Also, such prior buckles have a reversely turned flange at the front end of the buckle to pivotally mount the latch lever and this adds additional metal and weight to the buckle body. Thus, it will be seen that buckle body of the present invention may be small, light weight and left unchromed.

The latch lever 22 is preferably a one-piece, preferably metallic, construction and is formed by stamping from a single piece of steel or other metal of sufficient strength. The latch lever, which is best seen in FIG. 8, includes the rectangular push-button section 45 held upwardly and rearwardly of a frontal pivot plate 50 by a pair of parallel cantilevered arms 54 which extend rearwardly from the pivot plate and then upturn to attach to each side of the push-button section. The latch lever 22 is formed by stamping a single piece of metal and bending the stamped metal. That is, the upturned cantilever arms are formed to cause a foreshortening of the latch lever metal piece by drawing the push-button section 48 longitudinally closer to the pivot plate 50 when the arms are bent upwardly from a flat sheet position. Preferably, the latch lever is foreshortened sufficiently that a front edge 53 of the push-button section 45 is aligned above the latch surface 20 on the pivot plate 50. Herein, the latch lever is only about 1.37 inches in total length and about 0.49 inches high. The pivot arms 30 which mount the latch lever on the buckle body 12 are laterally extending portions of the pivot plate 50 and, from tip to tip, are approximately the width of the buckle body between the outside edges of the upstanding channels 34. A rearward edge of the pivot plate 50 is bent upwardly to form the raised latch surface 20 which actually engages the latch plate 16 when it is inserted into the buckle body. The front sloping side of the raised latch surface has a large radius of curvature to help guide the tongue plate 16 over the latch surface with a minimum of effort.

Figure 2:
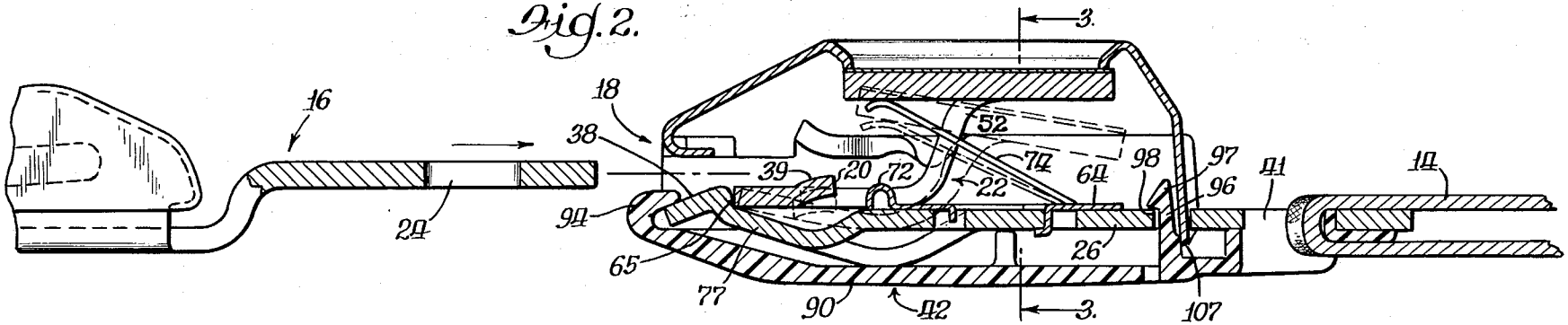
FIG. 2 is a vertical sectional view along the longitudinal centerline of the buckle in FIG. 1.

To provide a low profile for the buckle, the one-piece push-button and latch lever 22 is preferably mounted just above a top surface 54 of the base plate 26 when the pivot arms 30 are projected into the openings 32 in the upstanding, side channels 34. The openings 32 are positioned so that when the latch lever is in the upright, latched position, as shown in FIG. 2, the flat undersurface of the pivot plate 50 is just above the plane defined by the top surface 54 of the base plate. Thus, when the tongue plate 16 is inserted into the front end slot 18 in the buckle body 12, it slides over the pivot plate 50 and the raised latch surface 20 formed thereon. As noted earlier, the latch lever is spring biased in the upright position, and when the tongue plate 16 is inserted, it engages a front sloped side of the raised latch surface 20, depressing the latch surface as the tongue plate passes over it. When the latch plate is inserted sufficiently far that the opening 24 in the tongue plate passes over the raised latch surface, the spring bias causes the latch lever to pivot upwardly and the raised latch surface to extend upwardly into the opening 24 to prevent withdrawal of the tongue plate.

To facilitate insertion of the lateral pivot arms 30 into the openings 32 in the upstanding side walls 34 and 35, inturned projections 46 and 56 are spaced from each other by a slot 36 just above one of the openings 32. The slot is defined by walls 58. The latch lever may be simply and easily mounted on the buckle body 12 by first inserting one of the pivot arms at a downward angle into the opening 32 in the side wall 35, the pivot arms 30 being of sufficient length that the inserted arm may actually be pushed through this opening 32 in an amount to permit the other pivot arm to pass through the slot 36 between the projections 46 and 56. The pivot plate 50 is then rotated downwardly toward the surface 54 of the base plate 26. After the other pivot arm is aligned with the opening 32 in the side walls 34 below the slot 36, the latch lever is laterally adjusted so that each pivot arm 30 is received within one of the openings 32 in the side walls 34 and 35 so as to transmit any forces imposed on the latch lever to the buckle body.

To further facilitate the insertion of the tongue plate 16 into the buckle body 12, a forward corner 40 on the projection 46 is upturned to form a small ear. When the latch plate is inserted, the upturned corner 40 not only prevents the leading edge of the tongue plate from catching or snagging on the edge of the projection 46, but also allows a small amount of upward movement initially so that latch plate can be lifted slightly to slide more easily over the raised abutment surface 20 on the pivot plate 50. Upon further insertion of the latch plate 16 into the buckle body 12, a curved undersurface 60 of the corner ear acts as a cam to guide the tongue plate downwardly into engagement with the raised abutment surface 20. In the illustrated embodiment, substantially less force, as contrasted to some prior art buckles, is needed to insert the tongue plate into latching position on the buckle body.

Under extreme force loading of the latch lever 20 and the buckle body 12, a front edge 63 on the pivot plate 50 of the latch lever may be made to engage upstanding wall 65 of the tongue plate guide wall 38. As previously explained, this guide wall 38 is gently sloped to guide the tongue plate 16 over the pivot plate 50 of the latch lever 22 when it is inserted into the end slot 18 in the buckle body 12.

To bias the one-piece latch lever 22 in the latching position so that the raised latch surface 20 snaps upwardly into the opening 24 in the latch plate 16 when it is inserted over the pivot plate 50, a biasing means in the form of spring 62 is carried by the buckle body 12 and herein engages an undersurface of the push-button 45 to bias it in the raised position. The spring 62 is cut from a single piece of spring steel. It includes a generally flat central portion 64 with a depending insert 66 and hook 68 which engage the base plate 26 through openings 70 and 72 respectively to secure the spring 62 in a substantially centered position on the base plate surface 54. The front end of the central portion of the spring is sufficiently forward to underlie the latch plate 16 when it is inserted into the buckle body 12, and is formed with an upstanding curved section 72 resting on the base plate 26.

The spring 62 biases the latch lever 20 into an upright or latched position by a pair of cantilever spring arms 74 which extend at an angle upwardly from the base of the spring to the undersurface of the push button section 45, which curved free ends 75 of the spring arms slidingly engage. That is, ends 75 of the spring arms are turned downwardly to form a smooth contact shoulder for sliding engagement with the undersurface.

As described briefly earlier, when the tongue plate 16 is inserted into the end slot 18 of the buckle body, it may first engage a forward sloped surface 38 of the raised stop 59 on the base plate which guides the tongue plate over the pivot plate 50 of the latch lever 22 and to the curved frontal side of the raised latch surface 20. As the latch plate is further inserted, it depresses the raised latch surface and slides over the pivot plate 50. The upturned corner 48 of one of the side channels permits additional play in at least one side of the latch plate as it is inserted, allowing it to slide more easily over the raised latch surface. The curved undersurface 60 of the corner 48 cams the latch plate downwardly upon further insertion until the raised latch surface can snap upwardly, due to the bias of the spring 62, into the opening 24 in the latch plate. Withdrawal of the latch plate is then prevented by engagement between the raised latch surface 20 and the front edge of the opening 24 in the latch plate which acts to abut the latch surface.

To release the tongue plate 16, the push button section 45 of the latch lever 22 is depressed to pivot the latch lever downwardly, about its frontal edge 63, until the latch surface 20 is withdrawn from the opening 24 in the tongue plate, thereby releasing the latch plate for withdrawal. To accommodate the downward pivoting of the latch lever 22, which is mounted just above the plane of the surface 54 of the base plate 26, opening means and downwardly sloped portions of the base plate 26 are formed to allow the lower ends 75 of the upstanding lever arms 52 to pivot to positions lower than the upper surface 54 of the base plate. Also, portions of the lateral arms 30 pivot below the surface 54. More specifically, and as best seen in FIG. 5, the base wall 26 is formed with a non-planar complex shape beneath the latch lever and includes a downwardly and rearwardly sloped section 77 extending at its forward end from the pivot mounting slots 32 and wall 65 to forward edges 78 of the openings 28. Furthermore, the openings 32 in the side walls 34 and 35 also extend into the sloped section 77 and terminate at walls 79 (FIG. 4) and the portions of the openings 32 in the base plate 46 permit lower rearward edges 80 (FIG. 8) of the pivot arms 30 to pivot a position lower than the plane of the rearward surface of the base plate 46. A central web 85 (FIGS. 4 and 5) is formed in the base plate and is joined to the lower and rearward end of the downwardly inclined section 77 and is sloped upwardly toward and joins the rearward planar portion of the base at the ends of the openings 28. In this manner, and because the latch lever is mounted just above the planar surface of the base plate, portions of the latch lever pivot plate 50, pivot arms 30 and cantilever arms 52 actually move to a position below the plane generally defined by the upper planar portion of the base plate when the latch lever is pivoted to a release position. This construction aids in providing a buckle body 12 with a streamlined and unobtrusive profile.

The open base plate has other advantages. Access through the openings 28 would permit the insertion of a switch feeler or contact for sensing when the safety belt is buckled. This switch may in turn be connected to an ignition switch or to a warning light or buzzer to alert the occupant if the buckle is not fastened.

The buckle body 12 and latch lever 20 are mounted in a cover means which comprises the plastic cover 42 secured to the underside of the body and the cover 44 carried on top. The plastic cover 42 includes a bottom wall 90 (FIG. 3) and a pair of side walls 92 (See FIG. 3). The bottom wall is slotted for registering with the seat belt attachment slot 41 in the buckle body. The plastic cover includes a front lip 94 (FIG. 2) which overlaps the front edge of the buckle body and a rearward upstanding plastic hook 96 with an enlarged head 97 which snaps through an opening 98 in the base plate 26 to secure the cover 42 thereto. The plastic cover should be assembled after the latch lever 22 has been inserted since the side of the cover would not permit the pivot arms 30 to be inserted sufficiently through the openings 32 as described earlier. The cover 42 is fastened to the buckle body by pushing the frontal edge of the body down into the plastic cover under the lip 94 and then pressing the rear portion of the base plate downward until the plastic hook 96 of the cover snaps upward through the opening 98 in the base plate. The plastic cover 42 also functions to retain and center the latch lever pivot arms 30 which are slidable laterally. More specifically, either of the outer end walls 101 on the pivot arms will abut an upstanding side wall 92 of the plastic cover if the latch lever 20 should shift laterally along the base. Thus, the cover side walls will prevent a pivot arm from sliding laterally to a position where it would leave its opening 32 in a sidewall 34 or 35. Furthermore, the cover bottom wall 90 covers the openings 28 and prevents snagging of the occupant's cloths by any portion of the buckle body or latch lever.

The cover 44 which overlies the top of the buckle body is similarly secured. Although it might also be constructed of plastic or other suitable material, it is preferably of polished metal. As best seen in FIG. 2, an inwardly turned front lip 105 on the aluminum cover hooks onto projections 56 and 106 which extend inwardly from the upstanding side walls 34 and 35. The underside of each projection is provided with a recess 109 to receive the lip 105 and a rearward clip 107 depends from the cover to snap into the same opening 98 as does the plastic hook 96 of the bottom cover. As may be seen in FIG. 3, the lower edges of the cover 44 may abut the upper edges of the plastic cover 42 to provide a substantially continuous and smooth cover around the base plate. And to permit access to the push-button section 45 of the latch lever 22, the cover 44 includes a generally rectangular top opening, the edges of which engage and overlie the periphery of the push-button section 45. With the top and bottom covers in place, the buckle has an overall width of about 1.82 inches, an overall height of about 0.89 inches and an overall length of about 2.89 inches.

The tongue plate 16 is of typical safety belt D-ring construction and is made of a generally flat metallic plate, one end of which is attached to a seat belt portion or to a structural member and the other end of which comprises a D-ring or tongue plate with the opening 24 for insertion into the buckle body. The D-ring is to be inserted through the end slot 18 in the buckle body 12 and between the projections on the upstanding side walls 34 and 35. This guides the latch plate over the top of the pivot plate 50 of the latch lever 22. The D-ring portion of the latch plate is of sufficient width to extend substantially from one inside surface of side wall 34 to the inside surface of the other side wall 35 on the other side of the buckle body. The center opening 24 is provided to permit the raised latched surface 20 on the latch lever to snap upwardly after the tongue plate is inserted, thereby preventing withdrawal of the tongue plate by direct engagement between the raised latch surface and a facing edge of the opening which acts as an abutment surface against the raised latch surface.

Although the buckle body 12 and latch lever 22 are small, they have been designed to withstand heavy tensile force loadings of 5000 pounds or greater. To this end, the buckle base plate 26 is stiffened by the upstanding wall 65 which, under such loadings, abuts a relatively long extent of the edge 63 of the plate 50 of the latch lever 22 to prevent bending failure of the plate 50 or of the forward portion of the buckle base plate 26. More specifically, under such heavy loadings, the front edge 63 of the latch lever 22 engages the vertically extending wall 65 on the base plate to transmit loading from the latch lever 22 directly to the buckle body 12 at and along the central portion of the latch lever and base plate 26 as well as at the ends where the pivot arms 30 engage the upstanding side walls 34 and 35 of the buckle base. Preferably, the upstanding wall 65 has a flat vertical surface to provide good contacting engagement with the flat vertical wall surface defining the front edge 63 of the latch lever so as to prevent a camming of the front edge 63 over the wall 65 when very heavy loads are applied to the buckle. Together the sloping surface 38 and the upstanding wall 65 on the buckle base provide a reinforcing or stiffening configuration to the front end portion of the buckle body base plate 26 which allows a foreshortening of the buckle base plate. That is, the extent of this forward portion of the base plate 26 need not be as long as it would need to be if it were not stiffened by the upward deformation of the metal to form the wall 65 and surface 38. This is in contrast to prior art buckles which lack such a stiffening and have a flat longer plate portion to provide more metal to resist deformation under beam loads than does a bent metal plate, which has been bent to resist such beam loadings. If either the sloped surface 38 or the upstanding wall 65 were perforated, then the stiffening provided by this configuration would be reduced because under high loadings the base plate could begin to bend at the perforation.

It can therefore be seen that the present invention provides a short, low profile safety belt buckle that is uniquely simple and easy to assemble at a minimum cost. The latch lever 22 is of one-piece foreshortened construction, including a push-button section and is mounted just above the surface 54 of the buckle body base plate 26 to provide a low profile. Opening means in the base plate below the latch lever cooperate with the mounting described above to permit the latch lever to be pivoted downwardly into a recess and into a pair of spaced openings in the base plate to a release position. The latch lever is simply mounted on the base plate by the pair of laterally extending pivot arms which are inserted into the openings 32 in upstanding side channels 34 by tilting the pivot plate 50, inserting one arm in an opening 32 and rotating the latch lever downward for the other arm to pass through an access slot 36 between projections on one side wall. Minimum force is needed to insert the latch plate into the buckle body because gently sloped front sides on the stop surface and the raised abutment surface 20 combine with the upturned corner 40 to guide and cam the latch plate over and down behind the raised latch surface.

The present invention has been described in terms of the preferred embodiment, but certain changes may be made, some of which may immediately be apparent and others of which may be apparent only after some study, without departure from this invention.

What is claimed is:

1. In a safety belt buckle having a channel-shaped buckle body having a base and a pair of upstanding walls connected to opposite sides of said base for pivotally receiving opposite pivot arms on a latch lever for pivotally mounting the latch lever for pivoting by a push-button means against the biasing force of a spring means urging the latching lever upwardly to its latching position, the improvement for reducing the height and length of the buckle body comprising pivot arm receiving openings in said upstanding sidewalls at locations at substantially the plane of the buckle base of said channel-shaped buckle body for receiving said pivot arms and for locating said pivot axis adjacent said base web, openings in said buckle base allowing portions of said latch lever to pivot downwardly into said openings when said latch lever is operated by said push button means, and a cover means attached to said channel-shaped base member and extending across said openings in said buckle base and covering the latter and said portions of said latch lever.

2. A safety belt buckle in accordance with claim 1 in which said latch lever is a single piece and comprises a substantially flat planar portion having said pivot arms, an upwardly projecting latch surface on said planar portion located rearwardly of said pivot arms, a pair of upwardly bent arms connected to rearward portions of said planar portion, and an integral push-button section connected to the upper ends of said arms and extending forwardly to position a portion thereof adjacent and overlying said latch dog.

3. A safety belt buckle in accordance with claim 1 in which said openings in said upstanding side walls for receiving said latch lever pivot arms extend into said buckle base, and rearward edges of said latch lever arms pivot downwardly into said buckle base at said extended openings therein.

4. A safety belt buckle in accordance with claim 1 in which a pair of spaced projections are formed on the upper end of one of said side walls and define therebetween a slot through which may pass one of said latch lever pivot arms.

5. A safety belt buckle in accordance with claim 4 in which side wall portions of said cover means are positioned adjacent outer ends of said latch lever pivot arms to prevent lateral movement of said latch lever from a centered position on said buckle body.

6. In a safety belt buckle having a channel-shaped load bearing buckle body with a pair of upstanding sidewalls with aligned openings in opposite sidewalls for pivotally mounting a pair of pivot arms projecting outwardly from opposite sides of a latch lever, a spring means for biasing the latch lever to its latching position, an inturned flange on the upper end of one of said sidewalls located generally above said aligned openings, the improvement comprising a pair of projections on the other of said sidewalls projecting toward said inturned flange, said projections being spaced to define a slot allowing one of the pivot arms on the latch lever to swing downwardly after the other pivot arm is inserted into an opposite pivot arm opening beneath said inturned flange and means for centering said latch lever within said buckle body with said pivot arms each pivotally mounted in an associated opening in a buckle body sidewall.

7. A safety belt buckle in accordance with claim 6 in which a downwardly and rearwardly inclined camming surface is formed on the rearward one of said pair of projections to cam and guide said tongue plate toward latching engagement with said latching lever.

8. A safety belt buckle in accordance with claim 4 in which said means for centering said latch lever comprises an external cover means having portions for abutting the outer free ends of said pivot arms.

9. In a safety belt buckle having a load bearing buckle body and an opening at one end to receive a tongue plate and a latching lever pivoted on said load bearing buckle body and biased by a spring means toward a latching position with said tongue plate, a raised latch surface on said lever for abutting in latched relationship an abutment wall formed by an opening in the tongue plate, and a push button for manual depression to pivot said latching lever toward a release position comprising means for guiding the tongue plate toward and into latching position with said latch surface comprising a first cam surface means for camming and guiding the tip of the latch plate upwardly and rearwardly as the tongue plate is inserted initially, and a second cam surface means located rearwardly and upwardly of said first cam surface means and having a downwardly and rearwardly inclined surface for deflecting said tongue tip downwardly and rearwardly and across said raised latch surface to deflect said latch lever against the urging of said spring means.

10. A buckle in accordance with claim 9 in which said load bearing buckle body is channel-shaped with a bottom base and said first cam surface is an upwardly and rearwardly inclined surface on said base.

11. A buckle in accordance with claim 10 in which said buckle body comprises a pair of upstanding walls and having one inturned flange overlying said bottom base, a pair of inwardly directed projections on the other end of the upstanding side walls, said downwardly and rearwardly inclined surface of said second cam means being formed on one of said projections.

12. A safety belt buckle comprising:

a tongue plate having an abutment surface and also having an end for connection to a load-bearing member for transmitting forces to and from said latch plate, a buckle body having a first end for connection to a load-bearing member for transmitting forces to and from said buckle body and an open section end for receiving said tongue plate, said buckle body including an underlying base plate, a pair of sidewalls extending from the sides of said base plate and having openings therein, a latch lever having laterally extending arms disposed within said openings in said sidewalls for pivotally mounting said latch lever on said buckle body, a latch surface on said latch lever for engagement with said abutment surface of said tongue plate to prevent withdrawal of said tongue plate from said openg end of said buckle body and to transmit forces between said buckle body and said tongue plate, spring means for biasing said latch lever to a fastened position in which said latch surface of said latch lever engages said abutment surface of said tongue plate to hold said latch plate against withdrawal, said latch lever also including a push button surface spaced from said lateral arms and operable by pushing to pivot said latch lever against said spring bias to a release position in which said raised latch surface is disengaged from said abutment surface to permit withdrawal of said tongue plate from said open end of said buckle body, a cover means for said buckle body, including a bottom portion covering a bottom side of said buckle body and a top portion overlying said buckle body, said top portion of said cover means having an access opening for pushing said push button surface to pivot said latch lever to a release position, and an end of said cover being open to permit the insertion of said latch plate having opening means therein for receiving a portion of said latch lever beneath the plane of the upper surface of said base plate whereby sufficient downward movement is allowed for said raised latch surface to travel to its release position, said opening means in said base plate being covered by said bottom portion of said cover means.

13. A safety belt buckle in accordance with claim 12 in which said one-piece latch lever includes a flat pivot plate mounted by said laterally extending arms with the lower surface of said flat pivot plate being located at a plane which is generally defined by the top surface of said base plate until the latch lever is depressed.

14. A safety belt buckle in accordance with claim 13 in which said opening means in said base plate comprises a recess below said pivot plate and a pair of spaced openings, said latch lever including a pair of cantilevered support arms having lower ends for insertion into said openings as said latch lever is pivoted to a release position.

15. A safety buckle in accordance with claim 12 in which an upstanding wall is formed in said base plate to stiffen a portion of said base plate and to engage said latch lever thereby providing a reduction in the length of said base plate.

16. A safety belt buckle comprising a tongue plate having an abutment surface and also having an end for connection to a load-bearing member for transmitting forces to and from said latch plate, a buckle body having a first end for connection to a load-bearing member for transmitting forces to and from said buckle body and an open second end for receiving said tongue plate, said buckle body including an underlying base plate, a portion of the upper surface of said base plate defining a generally horizontal plane and a pair of flanges upstanding from the sides of said base plate and having openings therein, a one-piece latch lever having laterally extending pivot arms disposed within said openings in said upstanding flanges for pivotally mounting said latch lever on said buckle body, a latch surface on said latch lever for engagement with said abutment surface of said tongue plate from said open end of said buckle body and to transmit forces between said buckle body and said tongue plate, spring means for biasing said latch lever to a fastened position in which said latch surface of said latch lever engages said abutment surface of said tongue plate to hold the latter against withdrawal, said latch lever being operable by pivoting against said spring bias to a release position in which said raised latch arms surface is disengaged from said abutment surface to permit withdrawal of said tongue plate from said open end of said buckle body, a cover means for said buckle body, including a bottom portion covering a bottom side thereof and a top portion overlying said buckle body, said top portion of said cover means having an access opening for pivoting said latch lever to a released position, an end of said cover means being open to permit insertion of said tongue plate into said open end of said buckle body, said latch lever being of foreshortened, one-piece construction with a push button surface supported upwardly and rearwardly of said lateral pivot arms by a pair of cantilevered support arms, said push-button surface operable by pushing to pivot said latch lever to said release position.

17. A safety belt buckle in accordance with claim 16 in which said lateral arms extend from a pivot plate from which said cantilevered arms extend, said raised latch surface being formed from a rearward edge of said pivot plate, intermediate of said lateral arms.

18. A safety belt buckle in accordance with claim 17 in which said base plate includes a raised stop surface to abut a front edge of said pivot plate to help transmit forces between said buckle body and said latch lever.

19. A safety belt buckle in accordance with claim 18 in which said raised stop surface and said raised latch surface include gently sloped front surfaces to help guide said latch plate into said buckle body.

20. A safety belt buckle comprising a tongue plate having walls defining an opening therein and also having an end for connection to a load-bearing member for transmitting forces to and from said tongue plate, a buckle body having a first end for connection to a load-bearing member for transmitting forces to and from said buckle body and a slotted second end for receiving said tongue plate, said buckle body including an underlying base plate with a pair of spaced openings therein, a pair of channel defining walls upstanding from the sides of said base plate, inwardly projecting portions on said side walls overlying said base plate forming slots along the sides of the base plate for receiving said tongue plate, a one-piece latch lever having laterally extending plate-like arms disposed within receiving openings in said upstanding side walls for pivotally mounting said latch lever on said buckle body just above a plane of the upper surface of said base plate, said projections on one of said side walls defining an access slot allowing insertion of one of said laterally extending arms of said latch lever into said receiving openings, a raised latch surface on said latch lever intermediate of said laterally extending arms for engagement with one of said opening defining walls of said tongue plate to prevent withdrawal of said tongue plate from said slotted end of said buckle body and to transmit forces between said buckle body and said tongue plate, said latch lever being foreshortened and including a pair of parallel upstanding arms and a push-button surface cantilevered upwardly and rearwardly of said laterally extending plate-like arms by said pair of parallel upstanding arms disposed above said pair of spaced openings in said base plate, a pair of spring arms carried by said base plate and disposed between an undersurface of said push-button surface and said base plate and in slidable spring contact with said undersurface to bias said latch lever to a fastened position in which said raised latch surface extends upwardly into said opening in said latch plate and abuts one of said opening defining walls to hold said tongue plate against withdrawal, said push-button surface of said latch lever being operable by pushing to pivot said latch lever against said spring bias to a release position in which said raised latch surface is removed from said opening in said tongue plate and disengaged from said wall to permit withdrawal of said tongue plate from said slotted end of said buckle body, a portion of said base plate underlying said laterally extending arms of said latch lever being recessed and including a pair of spaced openings to permit pivoting of said laterally extending arms to a release position spaced below the plane defined by the upper surface ofsaid base plate, said upstanding arms of said latch lever being disposed within said pair of spaced openings.

* * * * *

UNITED STATES PATENT AND TRADEMARK OFFICE

CERTIFICATE OF CORRECTION

PATENT NO. : 4,064,603

DATED : December 27, 1977

INVENTOR(S) : Louis Romanzi, Jr.

It is certified that error appears in the above-identified patent and that said Letters Patent are hereby corrected as shown below:

Column 3, line 29, after "than" insert --two-thirds (2/3)--; delete "2/3".

Column 9, line 56, before "lever" insert --latching--.

Column 9, line 59, after "position" insert --releasing the tongue plate for removal, the improvement--.

Column 11, line 26, after "plate" insert --to prevent withdrawal of said tongue plate--.

Column 12, line 55, "ofsaid" should be --of said--.

Signed and Sealed this

*Thirty-first* Day of *October 1978*

[SEAL]

*Attest:*

RUTH C. MASON
*Attesting Officer*

DONALD W. BANNER
*Commissioner of Patents and Trademarks*